US006141999A

United States Patent [19]

Whittaker et al.

[11] Patent Number: 6,141,999

[45] Date of Patent: Nov. 7, 2000

[54] LOTTERY TICKETS SCRATCHER AND BRUSH KEY CHAIN

[76] Inventors: Charles H. Whittaker, 5552 W. Reighmoor Rd., Omro, Wis. 54963; Kevin E. Jorgensen, 2115 Allerton Dr., Oshkosh, Wis. 54904

[21] Appl. No.: 09/394,333

[22] Filed: Sep. 13, 1999

[51] Int. Cl.[7] ..... A44B 15/00

[52] U.S. Cl. ..... 70/456 R; 15/111; D3/210

[58] Field of Search ..... 70/456 R; D3/207–212; 15/236.01, 111

[56] References Cited

U.S. PATENT DOCUMENTS

| | | | |
|---|---|---|---|
| D. 290,056 | 5/1987 | Hatfield | D32/46 |
| D. 311,980 | 11/1990 | Baker | D32/46 |
| D. 353,239 | 12/1994 | Briscoe | D32/42 |
| 4,757,567 | 7/1988 | Booker | 15/105 |
| 4,777,693 | 10/1988 | Diba et al. | 15/236.01 |
| 5,069,050 | 12/1991 | Chen | 70/456 R |
| 5,388,439 | 2/1995 | Miller | 70/456 R |
| 5,615,441 | 4/1997 | Savini | 15/111 |
| 5,620,089 | 4/1997 | Mills | 70/456 R X |
| 5,713,232 | 2/1998 | Hodge | 70/456 R |
| 5,737,951 | 4/1998 | Krass | 70/456 R |
| 5,857,237 | 1/1999 | Dranginis | 15/236.02 |
| 5,956,985 | 9/1999 | Chang | 70/456 R |

*Primary Examiner*—Suzanne Dino Barrett
*Attorney, Agent, or Firm*—Patent & Trademark Services; Joseph H. McGlynn

[57] ABSTRACT

A combination key chain, lottery ticket scratcher and brush and has fastener at one end to attach the scratcher to a key chain and a brush at the other end to brush away the scrapings from a lottery ticket. In addition, there is a second fastener which can be used to attach the scratcher to a vertical surface.

8 Claims, 1 Drawing Sheet

LOTTERY TICKETS SCRATCHER AND BRUSH KEY CHAIN

BACKGROUND OF THE INVENTION

This invention relates, in general, to key chains, and, in particular, to a key chain which has a lottery ticket scratcher and brush attached

DESCRIPTION OF THE PRIOR ART

In the prior art various types of ticket scratchers have been proposed. For example, U.S. Pat. No. Des. 290,056 to Hatfield which discloses a key chain with a scratcher attached.

U.S. Pat. No. Des. 311,980 to Baker which discloses a key chain with a scratcher attached.

U.S. Pat. No. Des. 353,239 to Brisco which discloses a key chain with a scratcher attached that is shaped like a finger.

U.S. Pat. No. 5,713,232 to Hodge which discloses a combined key fob and scraper device.

SUMMARY OF THE INVENTION

The present invention is directed to a combination key chain, lottery ticket scratcher and brush and has fastener at one end to attach the scratcher to a key chain and a brush at the other end to brush away the scrapings from a lottery ticket. In addition, there is a second fastener which can be used to attach the scratcher to a vertical surface.

It is an object of the present invention to provide a new and improved key ring.

It is an object of the present invention to provide a new and improved key ring which has incorporated thereon a lottery ticket scratcher and brush.

It is an object of the present invention to provide a new and improved key ring which is inexpensive and easy to manufacture.

These and other objects and advantages of the present invention will be fully apparent from the following description, when taken in connection with the annexed drawings.

DESCRIPTION OF THE PREFERRED EMBODIMENT

Figure 1:
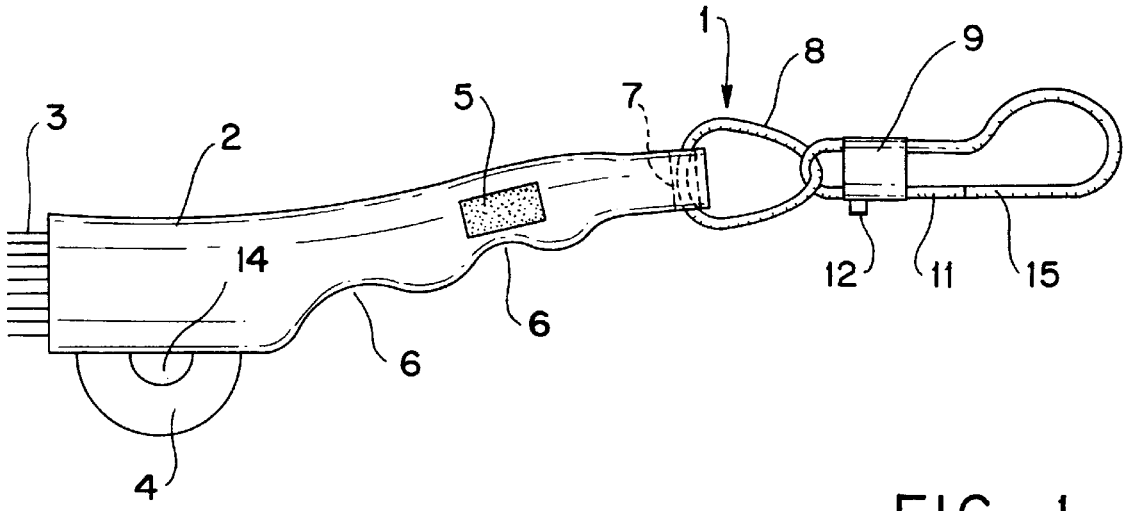
FIG. 1 is a side view showing one side of the present invention.

Referring now to the drawings in greater detail, FIG. 1 shows the combination lottery ticket scratcher, brush and key chain 1 of the present invention. The scratcher has a body 2 which has a plurality of bristles 3 at one which can be used to brush off the lottery ticket after the coating has been scratched off the ticket numbers. The bristles 3 project from one end and can be made from any suitable material and attached to the body in any conventional manner.

Positioned along one side of the body 2 are a plurality of depressions 6 into which a user can place their fingers to secure a good grip on the scratcher body. Positioned between the depressions 6 and the bristles 3 is a scratcher element 4. The element 4 has an aperture 14 which can be used to hang the scratcher on a hook or other fastener so the scratcher can be kept in a convenient location.

Positioned along one side of the body 2 is a hook and loop type fastener 5 which is another means for keeping the scratcher in a convenient location. This fastener 5 is the part of the hook and loop type fastener which has the hooks so it can be used to attach the scratcher to any material which has loops to cooperate with the hooks on the fastener 5.

Figure 2:
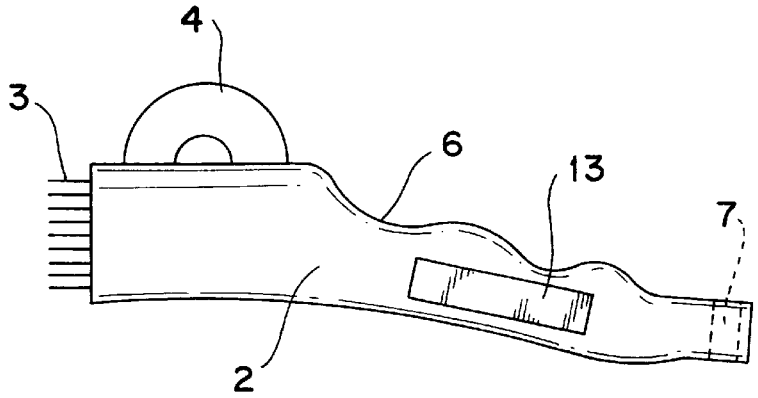
FIG. 2 is a side view showing another side of the present invention.

At the right end, as seen in FIG. 1, the body 2 has an aperture 7 which passes through this end of the fastener. Attached through this aperture 7 is a ring 8 similar to the type of rings that are used to attach keys. Attached to the ring 8 is a spring fastener 9 which has a curved portion 10 with a non movable end 15. Immediately adjacent the end 15 is a movable portion 11 which can be withdrawn into the fastener 9 by sliding the button 12 to the left. Moving the button 12 to the left will separate the ends 11, 15 apart so the fastener 9 can be attached to objects such as belts or belt loops. In the alternative, the fastener 9 can be used to attach items, such as keys. The fastener 9 is a conventional fastener that has a button 12 which is spring biased to the right, as shown in FIG. 1 to keep the ends 11, 15 closed FIG. 2 shows the other side of the present invention with the ring 8 and the fastener 9 removed for clarity. This other side shows another fasteners 13 which is a magnet which can be used to attach the scratcher to a metal, vertical surface.

As can be seen the present invention 1 solves a persistent problem keeping the scratcher in a convenient location where it can be easily located when the user desires to scratch off the coatings used on lottery scratch tickets. The various fasteners, i.e. the hook and loop type fastener 5 the spring biased hook fastener 9 the aperture 14 and the magnet 13 offer the user a wide variety of fastening options. This will provide a convenient way of keeping the scratcher in a convenient location where it will always be easy to find when needed to scratch lottery tickets.

When needed, the user can retrieve the scratchers from where it is stored, use the scratcher portion 4 to scrape off the coating on the lottery ticket, and then use the bristles 3 to brush away the residue of the coating.

Although the Lottery Ticket Scratcher & brush Key Chain and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What is claimed is:

1. A combination lottery ticket scratcher, brush and key ring comprising:

a body having a first end and a second end and two opposite side surfaces joining said first and second ends, means for scratching lottery tickets positioned adjacent said first end, means for brushing off said lottery tickets positioned at said first end, and means at said second end for attaching a fastener to said body, each of said two opposite side surfaces having mounting means for storing said combination lottery ticket scratcher, brush and key ring.

2. The combination lottery ticket scratcher, brush and key ring as claimed in claim 1, wherein said means for scratching lottery tickets is a circular element which has an aperture therethrough.

3. The combination lottery ticket scratcher, brush and key ring as claimed in claim 1, wherein said means for brushing off said lottery tickets is a plurality of bristles.

4. The combination lottery ticket scratcher, brush and key ring as claimed in claim 1, wherein said means at said second end for attaching a fastener to said body is an aperture that extends through said body.

5. The combination lottery ticket scratcher, brush and key ring as claimed in claim 4, wherein said fastener has a first portion that is not movable and a second portion that is movable, a slidable button for moving said second portion away from said first portion.

6. The combination lottery ticket scratcher, brush and key ring as claimed in claim 1, wherein said mounting means, on one of said two opposite side surfaces, for storing said combination lottery ticket scratcher, brush and key ring is a different type of mounting means from the mounting means on another of said two opposite side surfaces.

7. The combination lottery ticket scratcher, brush and key ring as claimed in claim 6, wherein said mounting means, on one of said two opposite side surfaces is a magnet.

8. The combination lottery ticket scratcher, brush and key ring as claimed in claim 6, wherein said mounting means, on another of said two opposite side surfaces is a hook and loop type fastener.

* * * * *